United States Patent [19]

Hammond et al.

[11] 4,339,336

[45] Jul. 13, 1982

[54] QUATERNARY AMMONIUM SUCCINIMIDE SALT COMPOSITION AND LUBRICATING OIL CONTAINING SAME

[75] Inventors: Kenneth G. Hammond; Harry Chafetz, both of Poughkeepsie, N.Y.

[73] Assignee: Texaco Inc., White Plains, N.Y.

[21] Appl. No.: 246,513

[22] Filed: Mar. 23, 1981

[51] Int. Cl.[3] ..... C10M 1/32

[52] U.S. Cl. ..... 252/34; 252/51.5 A; 546/281

[58] Field of Search ..... 252/34, 51.5 A; 546/281

[56] References Cited

U.S. PATENT DOCUMENTS

| | | | |
|---|---|---|---|
| 3,039,860 | 6/1962 | Andress, Jr. et al. | 252/34 X |
| 3,135,765 | 6/1964 | Andress, Jr. et al. | 252/34 X |
| 3,224,968 | 12/1965 | Hinkamp | 252/34 X |
| 3,235,556 | 2/1966 | Wakeman et al. | 252/34 X |
| 3,723,460 | 3/1973 | Brannen et al. | 252/34 X |
| 3,778,371 | 12/1973 | Malec | 252/34 X |
| 3,950,341 | 4/1976 | Okamoto et al. | 252/34 X |
| 4,108,858 | 8/1978 | Malec | 252/34 X |
| 4,248,719 | 2/1981 | Chafetz et al. | 252/34 |
| 4,251,380 | 2/1981 | Hammond et al. | 252/34 |
| 4,253,980 | 3/1981 | Hammond et al. | 252/34 |

*Primary Examiner*—Andrew Metz

*Attorney, Agent, or Firm*—Carl G. Ries; Robert A. Kulason; James J. O'Loughlin

[57] ABSTRACT

A quaternary ammonium succinimide salt composition represented by the formula:

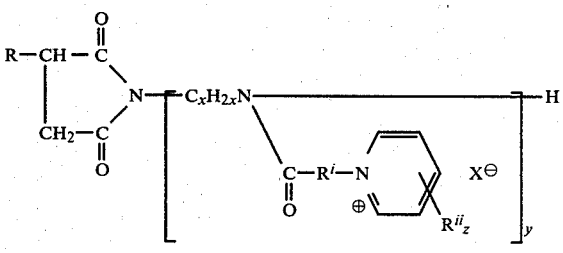

in which R is a hydrocarbyl radical having from 25 to 200 carbon atoms, $R^i$ is a divalent hydrocarbon radical having from 1 to 10 carbon atoms, $R^{ii}$ is a hydrocarbyl radical having from 1 to 10 carbon atoms, X has a value of 2 or 3, y has a value from 1 to 5, z has a value of 0 to 5, and X is a halide radical is provided, as well as a method of preparation and a lubricating oil composition containing same.

6 Claims, No Drawings

QUATERNARY AMMONIUM SUCCINIMIDE SALT COMPOSITION AND LUBRICATING OIL CONTAINING SAME

BACKGROUND OF THE INVENTION

1. Field of the Invention

Internal combustion engines operate under a wide range of temperatures including low-temperature stop-and-go service as well as high-temperature conditions produced by continuous high speed driving. Stop-and-go driving, particularly during cold, damp weather conditions, leads to the formation of sludge in the crankcase and in the oil passages of a gasoline engine. This sludge seriously limits the ability of the crankcase oil to lubricate the bearings and sliding wear surfaces in the engine or to act as a coolant. In addition, the sludge serves to contribute to rust formation within the engine because it tends to retain water in areas susceptible to corrosion. The noted problems are compounded by lubrication service maintenance recommendations calling for extended oil drain intervals.

It is known to employ nitrogen-containing dispersants and/or detergents in the formulation of crankcase lubricating oil compositions. Many of the known dispersant/detergent compounds are based on the reaction of an alkenylsuccinic acid or anhydride with an amine or polyamine to produce an alkenylsuccinimide or an alkenylsuccinamic acid as determined by selected conditions of reaction.

It is also known to chlorinate alkenylsuccinic acid or anhydride prior to the reaction with an amine or polyamine in order to produce a reaction product in which a portion of the amine or polyamine is attached directly to the alkenyl radical of the alkenylsuccinic acid or anhydride. The thrust of many of these processes is to produce a dispersant reaction product typically containing from about 0.5 to 5% nitrogen. These dispersant additives exhibited a high degree of oil solubility and have been found to be effective for dispersing the sludge that is formed under severe low temperature stop-and-go engine operating conditions. However, it has become increasingly difficult to formulate lubricants with these additives which meet the present requirements with respect to the prevention or inhibition for the formation of varnish.

2. Description of the Prior Art

A copending application, Ser. No. 224,728, filed on Jan. 13, 1981, discloses a quaternary ammonium succinimide salt composition formed from an N-(haloalkyl)hydrocarbylsuccinimide and a heteroaromatic amine and lubricants containing same.

A copending application, Ser. No. 246,512, filed on Mar. 23, 1981, discloses a quaternary ammonium succinimide salt composition prepared from an aminopyridine derived hydrocarbylsuccinimide.

SUMMARY OF THE INVENTION

The quaternary ammonium succinimide salt composition of this invention is represented by the formula:

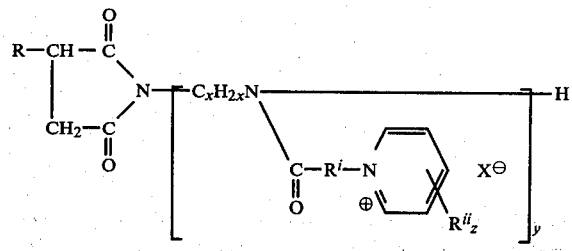

in which R is a hydrocarbyl radical having from 25 to 200 carbon atoms, $R^i$ is a divalent hydrocarbon radical having from 1 to 10 carbon atoms, $R^{ii}$ is a hydrocarbyl radical having from 1 to 10 carbon atoms, x has a value of 2 or 3, y has a value from 1 to 5, z has a value of 0 to 5, and X is a halide radical.

The novel quaternary ammonium succinimide salt composition of the invention is prepared by reacting a hydrocarbon substituted succinimide with a prescribed halocarboxylic acid derivative to produce an intermediate haloamide derivative of the succinimide compound. The intermediate is then reacted with a tertiary heteroaromatic amine to form the prescribed quaternary ammonium salt dispersant of the invention.

The lubricating oil composition or lubricant concentrate of the invention comprises a substrate of lubricant viscosity and an effective dispersant amount of the prescribed quaternary ammonium succinimide salt of the invention.

DESCRIPTION OF THE PREFERRED INVENTION

The novel quaternary ammonium succinimide salt composition of the invention is represented by the formula:

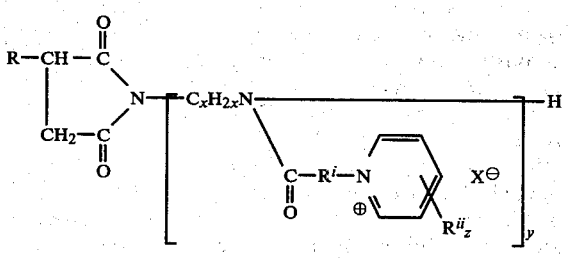

in which R, $R^i$, $R^{ii}$, x, y, z, and X have values indicated hereinabove. Hydrocarbyl is defined as a saturated or unsaturated monovalent hydrocarbon radical.

A preferred quaternary ammonium succinimide salt composition of the invention is one in which R is an alkenyl radical, such as a polybutenyl, polyisobutylenyl, and polypropylenyl radical, having from about 50 to 125 carbon atoms, $R^i$ is a methylene radical, $R^{ii}$ is hydrogen or a methyl radical, x has a value of 2, y has a value from 1 to 4, z has a value from 0 to 2, and X is a chloride or a bromide radical.

The preparation of the quaternary ammonium succinimide salt composition of the invention begins with a hydrocarbyl-substituted succinimide. This starting reactant is represented by the formula:

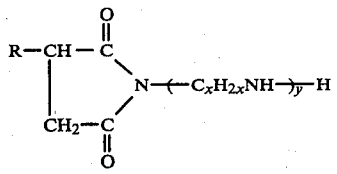

in which R, x and y have values noted above. The method for preparing hydrocarbyl succinimides is well known in the art and does not constitute a part of this invention.

The hydrocarbyl succinimide is reacted with a prescribed halocarboxylic acid derivative to produce an intermediate haloamide derivative of the succinimide compound. This intermediate is represented by the formula:

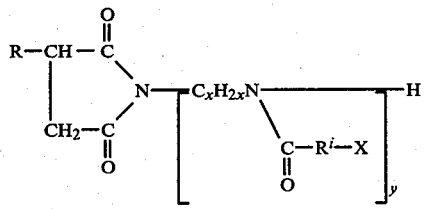

in which R, $R^i$, x, y, and X have the values noted above.

Halocarboxylic acid derivatives which can be employed in this reaction are represented by the formula:

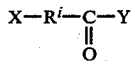

in which $R^i$ is a divalent hydrocarbon radical having from 1 to 10 carbon atoms, X is a halogen radical such as chloride, bromide, or iodide, and Y is a halogen radical such as chloride or bromide, or an alkoxy group such as the methoxy or ethoxy radicals. Typical halocarboxylic acid derivatives which are useful for preparing effective dispersants of this invention include chloroacetyl chloride, methyl chloroacetate, ethyl chloroacetate, bromoacetyl chloride, methyl bromoacetate, ethyl bromoacetate, 2-chloropropionyl chloride, methyl 2-chloropropionate, ethyl 2-chloropropionate, 3-chloropropionyl chloride, methyl 3-chloropropionate, ethyl 3-chloropropionate, 2-chlorobutyryl chloride, 3-chlorobutyryl chloride, 4-chlorobutyryl chloride, and 2-chlorodecanoyl chloride.

In general, the synthesis of the haloamide derivative of the succinimide is conducted by dissolving the hydrocarbyl succinimide in a suitable solvent (i.e. hydrocarbon solvents such as mineral oil, heptane, isooctane, benzene, toluene, or mixtures of these) and treating resulting mixture with a stoichiometric amount of the halocarboxylic acid derivative greater than or equal to that of primary and secondary amino functional groups present. The reactants are stirred or agitated for a sufficient time to effect formation of the haloamide. The resulting mixture is next filtered to remove solids and then stripped of volatiles at an elevated temperature under reduced pressure to yield the haloamide intermediate or an oil concentrate of the haloamide intermediate.

The following examples illustrate the method for preparing the intermediate haloamide of the succinimide compound.

EXAMPLE I

A solution containing a 50% mineral oil concentrate of a succinimide prepared by heating a 55 sap. no. polyisobutenyl (1300 MW) succinic anhydride with excess ethylenediamine in mineral oil solution and then stripping resulting product of volatiles at an elevated temperature under reduced pressure (500 g, 0.14 mole of primary amine fractional group based on 0.8% N), benzene (400 ml), and triethylamine (29 g, 0.29 mole) was stirred at room temperature as chloroacetyl chloride (32.0 g, 0.29 mole) was charged over about a half hour period. The resulting mixture was stirred at room temperature for about 18 hours, filtered to remove triethylamine hydrochloride and then stripped to 93° C. (35 mm Hg) to yield the chloroacetamide derivative of the succinimide, 0.8% N vs 0.8% N calculated and 1.5% Cl vs 1.0% Cl calculated.

EXAMPLE II

A solution containing a 50% mineral oil concentrate of a succinimide prepared by heating a 50 sap no. polyisobutenyl (1300 MW) succinic anhydride with tetraethylenepentamine (mole ratio anhydride to amine 1.0 to 0.9) (200 g, 0.12 mole of primary and secondary amine functional group based on 1.1% N), benzene (300 ml), and triethylamine (12 g, 0.12 mole) was stirred at room temperature as chloroacetyl chloride (12.9 g, 0.12 mole) was added slowly over a five minute period. The resulting mixture was stirred at room temperature for about 18 hours, filtered to remove triethylamine hydrochloride and then stripped to yield the chloroacetamide derivative of the succinimide, 1.2% N vs 1.1% N calculated, 2.0% Cl vs 2.0% Cl calculated.

The intermediate haloamide product is reacted with a tertiary heteroaromatic amine in order to form the prescribed quaternary ammonium salt. The effective tertiary heteroaromatic amine is represented by the formula:

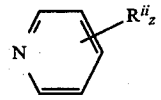

in which z is a number from 0 to 5 and $R^{ii}$ is hydrogen, or a hydrocarbyl radical having from 1 to 10 carbon atoms, or one or two pairs of "$R^{ii}$"s are interconnected to form one or two fused aromatic rings respectively.

The preferred heteroaromatic amine is one in which $R^{ii}$ is hydrogen or a lower aliphatic hydrocarbon radical having from 1 to 4 carbon atoms.

Examples of suitable tertiary heteroaromatic amines include pyridine, 3-methylpyridine, 3,4-dimethylpyridine, 4-methylpyridine, quinoline, isoquinoline, 3-ethylpyridine, and 4-ethylpyridine.

The following examples illustrate the method for preparing the quaternary ammonium succinimide salt composition of the invention.

EXAMPLE III

A mixture containing the haloamide derivative prepared in Example I (150 g) and pyridine (32.8 g) was stirred at 80° C. for 4 hours. The mixture was diluted with heptane, filtered, and then stripped to 80° C. (22 mm Hg) to yield a quaternary salt having 1.26% Cl vs 1.0% Cl calculated and 1.1% N vs 1.1% N calculated.

EXAMPLE IV

A mixture containing the haloamide derivative prepared in Example II (70 g) and pyridine (40.9 g) was stirred at 80° C. for 4 hours. The mixture was diluted with heptane, filtered, and then stripped to 66° C. (20 mm) to yield a quaternary salt having 1.7% Cl vs 2.0% Cl calculated and 1.6% N vs 1.8% N calculated.

The lubricant composition of the invention comprises a major amount of a mineral hydrocarbon oil or synthetic oil of lubricating viscosity and an effective detergent-dispersant amount of the prescribed quaternary ammonium salt. Advantageously, in the finished lubricating salt oil composition, the prescribed quaternary ammonium salt content ranges between about 0.1 and 10 percent by weight, preferably between about 0.5 and 5 weight percent. In the lubricating oil, concentrates, from which the finished lubricating compositions are derived via the addition of added lubricating oil, quaternary ammonium salt contents between about 10 and 50 weight percent are found. Thus, concentrations of the additive in lubricating oils and lubricating oil concentrates range from 0.1 to 50 weight percent.

The hydrocarbon oil in the finished lubricating composition advantageously constitutes at least about 85 weight percent and preferably between about 90 and 98 weight percent of the composition, and in the lube oil concentrates between about 50 and 90 weight percent of the composition. It is to be noted that even in the lubricating oil concentrates the prescribed quaternary ammonium salt will exhibit detergent-dispersancy.

Examples of the hydrocarbon base oil contemplated herein are the naphthenic base, paraffinic base and mixed base mineral oils, lubricating oils derived from coal products and synthetic oils, e.g., alkylene polymers such as polypropylene and polyisobutylene of a molecular weight of between about 250 and 2500. Advantageously, a lubricating base oil having a lubricating oil viscosity at 100° F. of between about 50 and 1000, preferably between about 100 and 600, are normally employed for the lubricant compositions and concentrates thereof (SUS basis).

In the contemplated finished lubricating oil compositions other additives may be included in addition to the dispersant of the invention. The additives may be any of the suitable standard pour depressants, viscosity index improvers, oxidation and corrosion inhibitors, anti-foamants, supplementary detergent-dispersants, etc. The choice of the particular additional additives to be included in the finished oils and the particular amounts thereof will depend on the use and conditions desired for the finished oil product.

Specific examples of the supplementary additives are as follows:

A widely used and suitable VI improver is the polymethacrylate having the general formula:

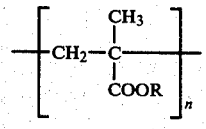

where R is an aliphatic radical of from 1 to 20 carbons and n is an integer of between about 600 and 35,000.

One of the most suitable VI improvers is the tetrapolymer of butyl methacrylate, dodecyl methacrylate, octadecyl methacrylate, and dimethylaminoethyl methacrylate having a respective component weight ratio in the polymer of about 4:10:5:1. Another VI improver is a copolymer of ethylene and propylene having a molecular weight of 20,000 to 50,000 containing 30 to 40 percent propylene in the copolymer in admixture with solvent neutral oil comprising 13 weight percent copolymer and 87 weight percent oil. The VI improvers are normally employed in the finished lubricant compositions in quantities between about 0.1 and 10 percent by weight.

One of the commonly employed lube oil corrosion inhibitors and antioxidants are the divalent dialkyl dithiophosphates resulting from the neutralization of a $P_2S_5$-alcohol reaction product with a divalent metal or divalent metal oxide. Barium and zinc dialkyl dithiophosphate are specific examples. Another class of antioxidants are the polyalkylated diphenylamines, such as a mixture of 2,2'-diethyl-4,4'-dioctyldiphenylamine and 2,2'-diethyl-4-octyldiphenylamine. The corrosion and oxidation inhibitors are usually present in the finished lubricating oil compositions in concentrations of between about 0.1 and 3 weight percent.

Examples of supplementary detergent-dispersants which can be employed are the monoethoxylated inorganic phosphorus acid-free, steam hydrolyzed polyalkylene (500–50,000 MW)-$P_2S_5$ reaction product, alkaline earth metal alkylphenolates, such as barium nonylphenolate, barium dodecylcresolate, calcium dodecylphenolate and the calcium carbonate overbased calcium alkaryl sulfonates formed by blowing a mixture of calcium hydroxide and a calcium alkaryl sulfonate, e.g., calcium alkyl benzene sulfonate of about 900 m.w. with carbon dioxide to form a product having a total base number (TBN) of 50 to more, e.g., 300 to 400.

If antifoamants are employed in the finished compositions, one widely used class which is suitable are the dimethyl silicone polymers employed in amounts of between about 10 and 1000 ppm.

The following test was employed to determine the dispersant effectiveness of the lubricant composition of the invention.

BENCH VC TEST

In the Bench VC Test, a mixtuure containing the test oil and a diluent are heated at an elevated temperature. After heating, the turbidity of the resultant mixture is measured. A low % turbidity (0–10) is indicative of good dispersancy while high results (20–100) are indicative of oils of increasingly poor dispersancy.

EXAMPLE V

A fully formulated SAE Grade 10W-40 lubricating oil composition containing the quaternary ammonium salt of the invention was tested for its dispersant effectiveness in the Bench VC Test in comparison to a fully formulated base oil without the amine salt dispersant, and to fully formulated lubricating oil compositions containing either a commercial succinimide dispersant or an intermediate product.

The base blend employed contained the following conventional additives:

0.15 weight % zinc as zinc dialkyldithiophosphate
0.23 weight % calcium as overbased calcium sulfonate
0.25 weight % alkylated diphenylamine antioxidant 11.5 weight % ethylene-propylene copolymer VI improver
0.15 weight % ethoxylated alkylphenol
0.10 weight % methacrylate pour depressant
150 ppm silicone antifoamant
mineral oil—balance (viscosity SUS at 100° F. of 120)

The quaternary ammonium salt dispersant of the invention and its precursors were added to the base blend at several concentration levels and then tested in the Bench VC Test.

The results are set forth in the table below:

TABLE I

| Run | BENCH VC TEST Wt. % of Additive in Base Blend[1] | | Turbidity |
|---|---|---|---|
| 1 | Base Blend (no dispersant) | | 97.5 |
| 2 | EDA Succinimide used in Example I | 6.0% | 13.0 |
| 3 | EDA Succinimide used in Example I | 4.0% | 36.0 |
| 4 | Haloamide Derivative of EDA Succinimide of Example I | 6.0% | 45.0 |
| 5 | Quaternary Ammonium Salt of Example III | 6.0% | 6.0 |
| 6 | Quaternary Ammonium Salt of Example III | 4.0% | 14.0 |
| 7 | TEPA Succinimide used in in Example II | 6.0% | 4.0 |
| 8 | TEPA Succinimide used in in Example II | 4.0% | 29.0 |
| 9 | Haloamide Derivative of TEPA Succinimide of Example II | 6.0% | 7.0 |
| 10 | Quaternary Ammonium Salt of Example IV | 6.0% | 5.5 |
| 11 | Quaternary Ammonium Salt of Example IV | 4.0% | 11.0 |

[1]All additives are approximately 50% concentrates in mineral oil.

The foregoing tests demonstrate that the prescribed quaternary ammonium salts of the invention are excellent dispersants for lubricating oil compositions exhibiting an effectiveness equal or superior to that of the succinimide and haloamide precursors from which they were prepared.

We claim:

1. A quaternary ammonium succinimide salt composition represented by the formula:

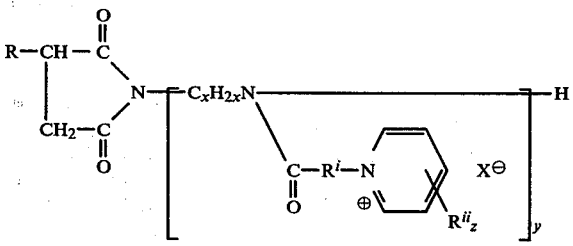

in which R is a hydrocarbyl radical having from 25 to 200 carbon atoms, $R^i$ is a divalent hydrocarbon radical having from 1 to 10 carbon atoms, $R^{ii}$ is a hydrocarbyl radical having from 1 to 10 carbon atoms, x has a value of 2 or 3, y has a value from 1 to 5, z has a value of 0 to 5, and X is a halide radical.

2. A quaternary ammonium succinimide salt composition according to claim 1 in which R is a hydrocarbon radical having from 50 to 125 carbon atoms, $R^i$ is a methylene radical, $R^{ii}$ is hydrogen or a methyl radical, x has a value of 2 or 3, y has a value from 1 to 5, z has a value of 0 to 2, and X is a chloride or bromide anion.

3. A quaternary ammonium salt composition represented by the formula:

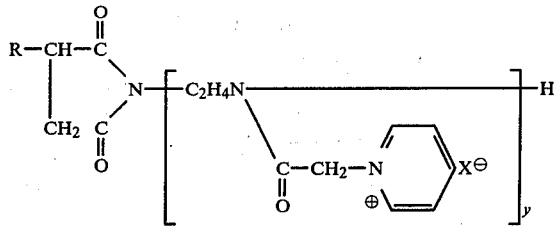

in which R is a hydrocarbyl radical having from 25 to 200 carbon atoms, y has a value from 1 to 4, and X is a chloride anion.

4. A lubricating oil composition comprising a major portion of a mineral lubricating oil and a minor dispersant amount of a quaternary ammonium succinimide salt composition represented by the formula:

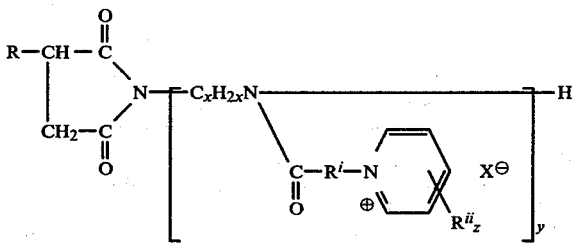

in which R is a hydrocarbyl radical having from 25 to 200 carbon atoms, $R^i$ is a divalent hydrocarbon radical having from 1 to 10 carbon atoms, $R^{ii}$ is a hydrocarbyl radical having from 1 to 10 carbon atoms, x has a value of 2 or 3, y has a value from 1 to 5, z has a value of 0 to 5, and X is a halide radical.

5. A lubricating oil composition comprising a major portion of a mineral lubricating oil and a minor dispersant amount of a quaternary ammonium succinimide salt composition according to claim 1 in which R is a hydrocarbon radical having from 50 to 125 carbon atoms, $R^i$ is a methylene radical, $R^{ii}$ is hydrogen or a methyl radical, x has a value of 2 or 3, y has a value from 1 to 5, z has a value of 0 to 2, and X is a chloride or bromide anion.

6. A lubricating oil composition comprising a major portion of a mineral lubricating oil and a minor dispersant amount of a quaternary ammonium salt composition represented by the formula:

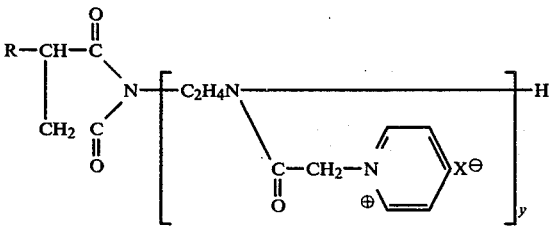

in which R is a hydrocarbyl radical having from 25 to 200 carbon atoms, y has a value from 1 to 4, and X is a chloride anion.

* * * * *